US006781071B2

(12) United States Patent
Leng et al.

(10) Patent No.: US 6,781,071 B2
(45) Date of Patent: Aug. 24, 2004

(54) ELECTRICAL SWITCH ACTUATING ELEMENT

(75) Inventors: Peter Leng, Rüsselsheim (DE); Paul Junker, Bingen (DE); Hermann Mahr, Waldalgesheim (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/258,044

(22) PCT Filed: Apr. 12, 2001

(86) PCT No.: PCT/DE01/01479

§ 371 (c)(1),
(2), (4) Date: Mar. 21, 2003

(87) PCT Pub. No.: WO01/82322

PCT Pub. Date: Nov. 1, 2001

(65) Prior Publication Data

US 2003/0155219 A1 Aug. 21, 2003

(30) Foreign Application Priority Data

Apr. 20, 2000 (DE) ..... 100 19 842
Aug. 26, 2000 (DE) ..... 100 42 065

(51) Int. Cl.[7] ..... H01H 9/00

(52) U.S. Cl. ..... 200/61.54; 200/293; 200/341; 200/5 A

(58) Field of Search ..... 200/61.54, 61.57, 200/293, 341, 5 A

(56) References Cited

U.S. PATENT DOCUMENTS 4,518,836 A * 5/1985 Wooldridge ..... 200/61.54
4,689,455 A * 8/1987 Watanabe ..... 200/534
5,475,192 A * 12/1995 Inagaki et al. ..... 200/341
5,585,606 A * 12/1996 Ricks ..... 200/61.08
6,087,600 A * 7/2000 Kaufmann et al. ..... 200/5 A
6,349,616 B1 * 2/2002 Onodera et al. ..... 74/552
6,365,852 B1 4/2002 Leng et al.
6,472,622 B1 10/2002 Besier
6,492,744 B1 12/2002 Rudolph et al.

FOREIGN PATENT DOCUMENTS

EP 887819 12/1998

* cited by examiner

*Primary Examiner*—Elvin G. Enad
*Assistant Examiner*—Richard K. Lee
(74) *Attorney, Agent, or Firm*—David P. Wood

(57) ABSTRACT

An actuating element for an electric switch, especially for a steering wheel switch in a motor vehicle, impinges upon at least one switching contact and is pivotally mounted on a housing of said switch. A firm hinge is provided as a bearing, connecting the actuating element to a latched wall. The wall runs parallel to the wall of the housing or replaces the wall of the housing.

12 Claims, 3 Drawing Sheets

ELECTRICAL SWITCH ACTUATING ELEMENT

TECHNICAL FIELD

The invention generally relates to electrical switches and more particularly related to an actuating element for an electrical switch.

BACKGROUND OF THE INVENTION

In general, in order to create a pivotable support for an actuating element of an electrical switch, support-axis stubs are formed perpendicularly to its direction of rotation, these stubs being opposably arranged on the switch and being inserted in corresponding housing recesses. However, the support-axis stubs are relatively prone to break, for which reason a reject can be generated if the actuating element is improperly mounted in the housing. If several such actuating elements are to be housed in a common housing, a corresponding number of support sites must be realized, at a significant manufacturing expense.

The direct connection of an actuating element to a housing via the intermediary of a film hinge is difficult in that the material for the housing must have different material properties from the material suitable for a strip of film. This problem cannot be solved by manufacture in a two-component injection molding process, since the different materials no longer combine sufficiently homogeneously in this process.

An actuating element for an electrical switch pivotably supported on a partition via a film hinge is known from U.S. Pat. No. 4,689,455 A. The partition is connected in a latching manner to a housing of the switch, and is aligned parallel to a housing wall. The actuating element and the partition are set into a recess of the housing.

Moreover, JP 06 290680 A (Patent Abstracts of Japan, Vol. 1995, No. 1, Feb. 28, 1995) discloses an actuating element for a switch, which actuating element is connected via a hinge to a partition associated with a housing wall. The housing wall has no guides for the partition.

Furthermore, an electrical pushbutton switch with an actuating element, pivotably supported on a housing, for applying pressure to a switching contact is known from EP 0 887 819 A2. A pushbutton support is provided for the pivotable support of each actuating element, said support consisting of at least one support bracket, with support pins, fixed to the housing, and of a corresponding flange hole located in a side wall of the actuating element.

The invention addresses the problem of creating an actuating element of the type initially cited that has a small number of individual parts, is mechanically robust, and in addition, is simple and economical to produce and mount.

The invention solves this problem in that a film hinge is provided as the hinge, said film hinge connecting the actuating element to a partition engaged with the housing, said partition covering the associated housing wall of the outside and being guided on the latter, and in that at least one stop arm is formed on the underside of the actuating element, said arm extending behind a projection formed on the housing wall opposite the film hinge.

As a consequence of this measure, it is not necessary to provide additional structural components for pivotable support of the actuating element. As a consequence of connecting the actuating element to the partition, it is possible to manufacture this partition from a suitable plastic upon which mechanical demands can be placed that differ in comparison to the material of the housing. For example, a plastic reinforced with glass fibers with high strength is used to manufacture the housing, said plastic not being usable in a film hinge and the visible surface of the actuating element. The actuating element is produced, with the film hinge and the relatively lightly loaded partition, from a non-reinforced plastic that assures the necessary elasticity and a high surface quality necessary for the visible surfaces of the actuating element. Relatively rapid assembly is assured in that the partition can be engaged with the housing. When the partition is arranged paralled to a housing wall, an increased stability of the housing is achieved. Furthermore, connection to a housing of differently-formed actuating elements is possible after an appropriate change of the die mole, so that given a design change, only the actuating elements are adapted while the housing and the switch parts inserted in it are kept the same. As a consequence of the guidance of the partition on the associated housing wall, positional fixation between the housing and the actuating element is assured. In order to prevent the actuating element from pivoting counter to the direction in which it is pressed, at least one stop arm is formed on the underside of the actuating element, said arm extending behind a projection formed on the housing wall opposite the film hinge The guide is advantageously designed as a dovetail guide. The dovetail guide assures guidance in two axes, and accordingly provides precise positioning of the actuating element in relation of the housing.

Several spaced-apart guide ridges of the housing wall, and corresponding guide grooves in the partition, are preferably provided. The guide ridges extend over approximately the entire height of the housing wall, and the guide grooves extend over approximately the entire height of the partition. Rotation of the partition relative to the housing wall is practically excluded by the relatively great lengths of the guides and their spacing apart from each other.

According to an advantageous further development of the concept of the invention several actuating elements are arranged parallel to each other perpendicularly to the longitudinal axis of the housing, those actuating elements each being connected to the partition via at least one film hinge. As a result, several switching functions are integrated into one housing; of course, a separate switching contact to be pressed is associated with each of the actuating elements.

Since the film hinge on the visible side of the actuating element is considered objectionable on visual and tactile grounds, the partition extends into the film hinge and an actuating surface of the actuating element extends substantially perpendicularly from the partition and/or the film hinge. The film hinge is thereby associated with the outermost edge area of the actuating element.

The one end face of the actuating element is preferably aligned flush with the partition and the associated film hinge, and the other end face preferably extends over part of the housing wall opposite the partition. Thus, the entire housing surface and the film hinges are covered by the actuating element or elements.

In order to effectively prevent the partition with the actuating element from being pulled off of the housing, at least one clip arm with a clip opening for latching reception of a clip projection formed on the housing wall is advantageously designed in the partition.

According to a further embodiment, perforated projections for attachment between spokes of a steering wheel are provided on a base of the housing, said base holding the switching contacts designed as a microswitch. The entire switch, which can be used, e.g., to control a Tempomat, is reliably connected to the steering wheel via the holes by screws.

In order to adapt the geometry of the housing to the installation situation on a steering wheel, the cross section of the housing is advantageously designed in a substantially triangular shape, in which the housing walls of the longitudinal sides form the sides of the triangle, an end face housing wall forms the base, and the other end face housing wall essentially forms an arcuate connection of the longitudinal-side housing walls.

The free end faces of the actuating elements opposite the film hinges are advantageously designed in an arc. In this manner, even the actuating elements are adapted to the contour of the steering wheel.

The switching contacts are relatively sensitive components that must be protected from being overloaded by too great a force when the actuating elements are pressed. Therefore, a stop is advantageously associated with each actuating element on the side opposite the film hinge, said stop coming to rest against the end face of the corresponding housing wall upon being pressed.

In order to convert the pivoting movement of the actuating element into a straight-line movement for applying pressure to the microswitch associated with it, a push rod associated with each actuating element for applying pressure to the corresponding microswitch is movably arranged, preferably on one of the housing walls of the longitudinal sides.

Of course, the previously cited features still to be explained in the following can be used not only in the particular combination indicated, but also in other combinations without departing from the scope of the present invention.

The invention is explained in the following using an exemplary embodiment and making reference to the associated drawings.

DETAILED DESCRIPTION OF THE PREFERRED EMBODIMENTS

Figure 1:
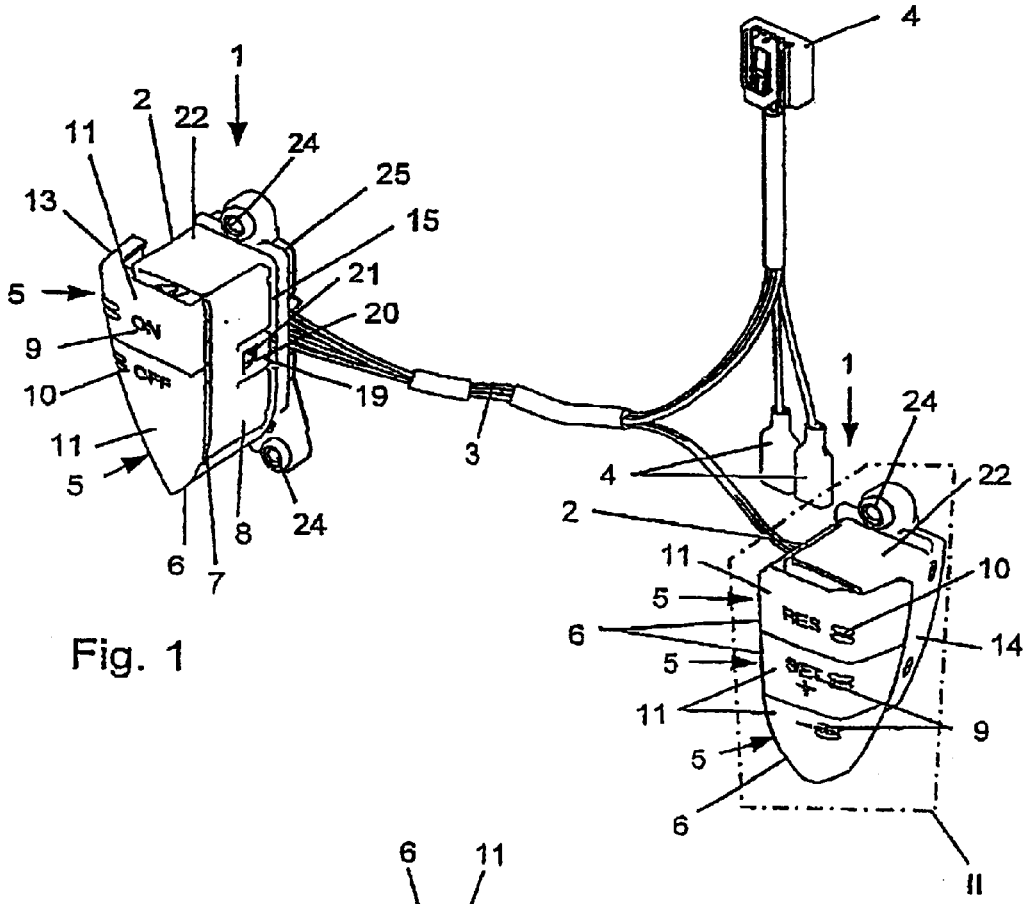
FIG. 1 shows an oblique view of a switch arrangement with actuating elements in accordance with the invention.
Figure 2:
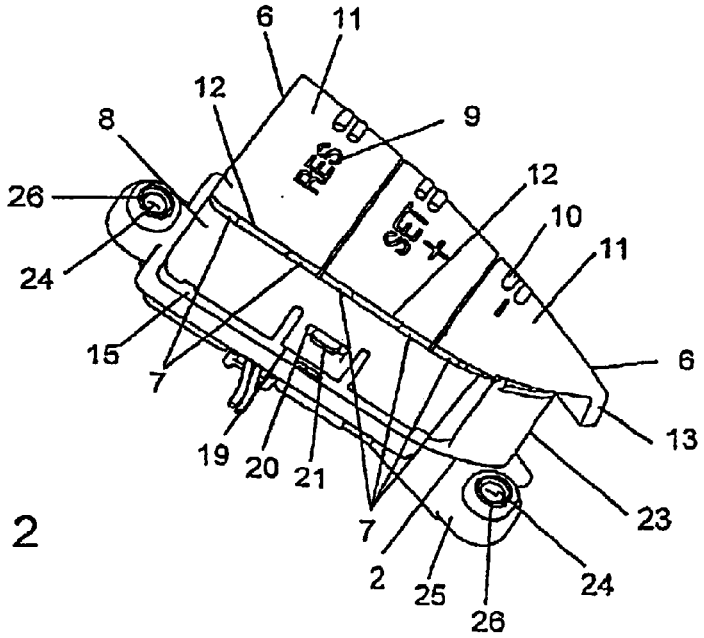
FIG. 2 shows an oblique view of a detail II according to FIG. 1.
Figure 3:
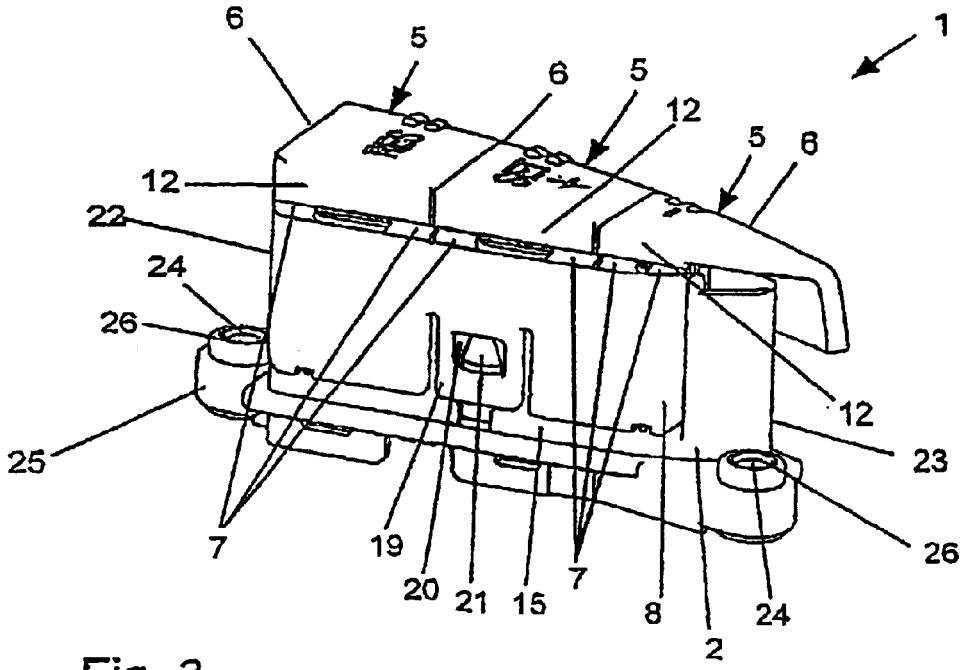
FIG. 3 shows another oblique view of detail II according to FIG. 1.
Figure 4:
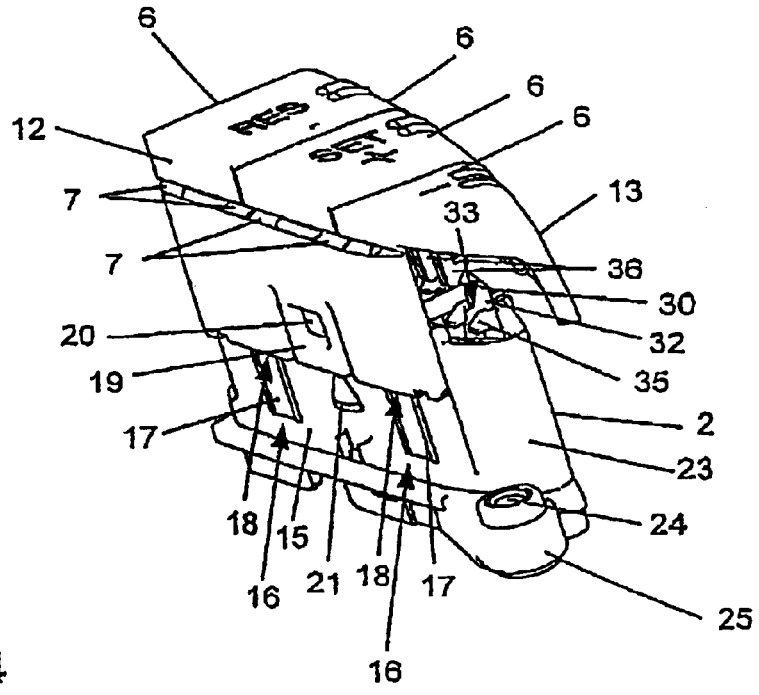
FIG. 4 shows a partially exploded view of detail II according to FIG. 1.
Figure 5:
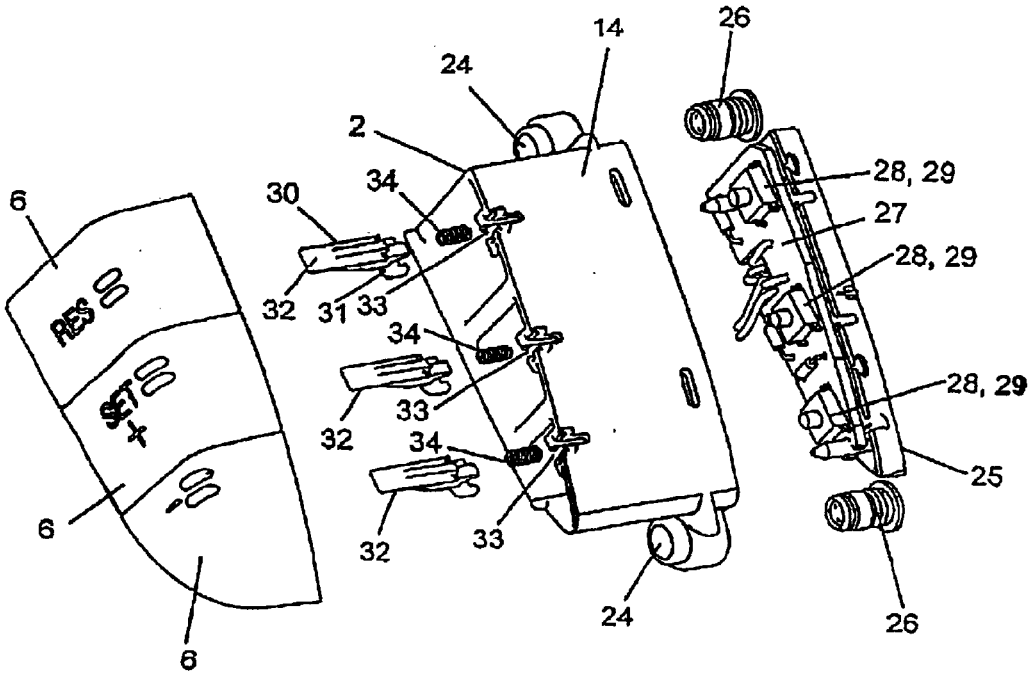
FIG. 5 shows an exploded view of detail II according to FIG. 1.
Figure 6:
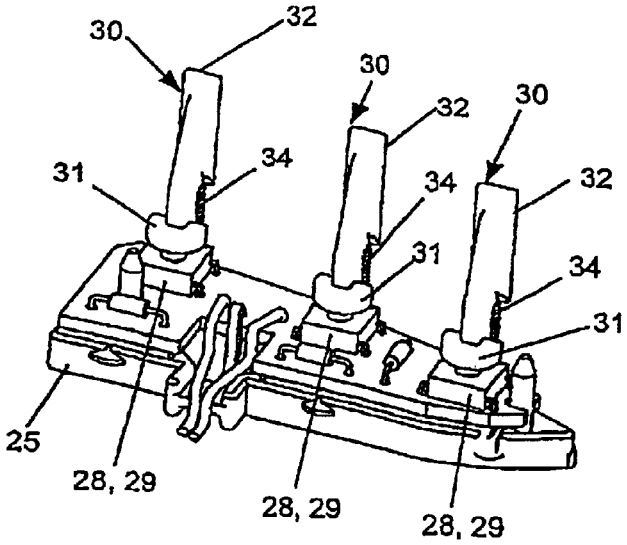
FIG. 6 shows a view of detail VI according to FIG. 5.

The switch arrangement serves to control a cruise control device, a so-called Tempomat, of a motor vehicle, and comprises two electrical switches 1, each with a housing 2. Switches 1 are connected to one another via leads 3 that end in common plug contacts 4 for connection to the vehicle electrical system. Two individual switches 5 are housed in the one housing 2, of which one serves to cut in the cruise control device and the other to cut it out. The other housing 2 receives three individual switches 5, one of which is provided for resetting the set speed, one for storing the instantaneous speed and increasing it and one for reducing the instantaneous speed of the motor vehicle, by means of the cruise control device. Switches 1 are fastened directly to a steering wheel (not shown) between its spokes so that the driver does not have to remove his hands from the steering wheel when pressing individual switches 5.

Each individual switch 5 comprises a pivotably supported actuating element 6 connected via spaced-apart film hinges 7 to partition 8, which partition 8 also supports the other actuating elements 6 associated with switch 1 via separate and spaced-apart film hinges 7. Partition 8 extends into film hinges 7 and actuating surface 11 of actuating element 6, this surface being provided with symbols 9 and tactilely perceivable elevations 10 and running substantially perpendicularly to partition 8. In order to cover partition 8 and also film hinges 7 such that they are not noticeable in the installed state of switches 1, the one end face 12 of actuating element 6 is aligned flush with partition 8, and thus covers partition 8 and film hinges 7 with actuating surface 11. End face 13 of actuating element 6, which is opposite to partition 8, extends partially over corresponding housing wall 14. Since actuating elements 6, which are arranged parallel to each other, extend for their entire width over the entire upper side of housing 2, the housing is barely noticeable visually in a top view of the switch.

Partition 8 extends parallel to longitudinal-side housing wall 15 and is lodged on it by means of spaced-apart dovetail guides 16. Guide ridges 17 are formed on housing wall 15 and guide grooves 18 corresponding to them are let into partition 8, said guide ridges 17 extending over approximately the entire height of housing wall 15 and said guide grooves extending over approximately the entire height of partition 8. In order to effectively secure partition 8 with associated actuating elements 8 to housing 2, clip arm 19 with clip opening 20 is formed in partition 8 into which opening a corresponding clip projection 21 of housing wall 15 engages.

In order to achieve a harmonious integration of switch 1 with the steering wheel, the cross-sectional area of housing 2 is designed substantially triangularly, with longitudinal-side housing walls 14, 15 forming the sides of the triangle, end-face housing wall 22 the base, and the other end-face housing wall 23 substantially forming an arcuate connection between longitudinal-side housing walls 14, 15. Fastening of switch 1 is effected via perforated projections 24 formed in housing 2 which receive a snapped-in socket 25. Metallic threaded sleeves 26 are inserted into holes 24.

Base 25 carries guide plate 27 with switching contacts 29 designed as microswitches 28, a separate microswitch 28 being associated with each individual switch 5. Push rod 30 is provided for actuating microswitch 28. Push rod 30 comprises receptacle 31 partially surrounding microswitch 28, which receptacle is connected to guide surface 32 running perpendicularly to it. Guide surface 32 is movably guided in substantially T-shaped groove 33, which groove 33 receives pressure spring 34 at the same time, said spring being supported between underside 35 of guide surface 32 and the bottom of groove 33. Projections 35 are formed on housing wall 14 on both sides of groove 33 and corresponding stop arms 36 extend behind these projections. The stop arms 36 are formed on the bottom of actuating element 6.

When actuating element 6 is pressed, it pivots on associated film hinge 7 and pushes push rod 30 against the force of pressure spring 34 in groove 33 in the direction of microswitch 28. An actuating element stop (not shown) comes to rest against the housing in a pressed end position of actuating element 6, whereby microswitch 28 is protected from mechanical overloading, and receptacle 31 of push rod 30 actuates microswitch 28. After actuating element 6 is released, it pivots back into an un-pressed end position as a result of the force of pressure spring 34 acting on push rod 30, and the stop arms of actuating element 6 come to rest against associated projections 35 of housing wall 14.

What is claimed is:

1. An actuating element for an electrical switch, comprising:

an actuating body, at least one switching contact influenced by said actuating body, wherein said switching contact is mounted in switch housing by way of a pivot mechanism, wherein said pivot mechanism includes a film hinge connecting the actuating body to a partition engaged with the switch housing wherein said partition covers an associated housing wall at least one stop arm formed on an underside of the actuating body, said arm extending behind a projection formed on a housing wall opposite the film hinge.

2. The actuating element according to claim 1, wherein said partition is guided on the housing wall by way of the guide is designed as a dovetail guide.

3. The actuating element according to claim 1, further including several spaced-apart guide webs of die housing wall, and corresponding guide grooves in the partition, said guide webs extending over approximately an entire height of the housing wall, and said guide grooves extending over approximately an entire height of the partition.

4. The actuating element according to claim 1, wherein several actuating bodies are arranged parallel to each other perpendicular to a longitudinal axis of the switch housing, said actuating bodies each being connected to the partition by way of at least one film hinge.

5. The actuating element according to claim 1, wherein the partition extends into the film hinge, and wherein an actuating surface of the actuating body runs substantially perpendicularly from the partition or the film hinge.

6. The actuating element according to claim 5, wherein a first end face of the actuating body is aligned flush with the partition and the associated film hinge, and wherein a second end face of the actuating body extends over part of the housing wall opposite the partition.

7. The actuating element according to claim 1, wherein at least one clip arm, with a clip opening for latching reception of a clip projection formed on the housing wall, is formed in the partition.

8. The actuating element according to claim 1, further including perforated projections, for attachment between spokes of a steering wheel, connected on a base of the housing, wherein said base holds the switching contacts designed as a microswitch.

9. The actuating element according to claim 8, wherein at least one stop in associated with each actuating body on the side opposite to the film hinge, said stop coming to rest on an end face of the corresponding housing wall when pressure is applied.

10. The actuating element according to claim 1, wherein a cross section of the housing is substantially triangular in shape, the housing wall forms the sides of the triangle, and wherein an end-face housing wail forms the base, and the other end-face housing wall essentially forms an arcuate connection of the longitudinal-side housing walls.

11. The actuating element according to claim 10, wherein the actuating bodies are designed in an arc.

12. The actuating element according to claim 1, further including a push rod, associated with each actuating body for applying pressure to the corresponding microswitch is movably arranged on one of the housing walls (14, 15) of the longitudinal sides.

* * * * *

UNITED STATES PATENT AND TRADEMARK OFFICE

CERTIFICATE OF CORRECTION

PATENT NO. : 6,781,071 B2
DATED : August 24, 2004
INVENTOR(S) : Peter Leng et al.

It is certified that error appears in the above-identified patent and that said Letters Patent is hereby corrected as shown below:

Column 5,
Line 26, change "die housing" to -- the housing --

Signed and Sealed this

Thirtieth Day of November, 2004

JON W. DUDAS
*Director of the United States Patent and Trademark Office*